US006358438B1

(12) United States Patent
Isozaki et al.

(10) Patent No.: US 6,358,438 B1
(45) Date of Patent: Mar. 19, 2002

(54) ELECTRICALLY CONDUCTIVE POLYMER COMPOSITION

(75) Inventors: Tsutomu Isozaki; Masaaki Takahashi, both of Tokyo (JP); Susan Melsa Jordan, Mountain View; Kevin Michael Stein, San Jose, both of CA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/364,504

(22) Filed: Jul. 30, 1999

(51) Int. Cl.[7] ..... H01B 1/06

(52) U.S. Cl. ..... 252/511; 252/500; 252/503; 252/512; 252/518.1; 338/22 R

(58) Field of Search ..... 252/500, 503, 252/511, 512, 518.1; 338/22 R

(56) References Cited

U.S. PATENT DOCUMENTS

| | | | | |
|---|---|---|---|---|
| 3,858,144 A | | 12/1974 | Bedard et al. | 338/22 R |
| 4,237,441 A | | 12/1980 | Van Konynenburg et al. | 338/22 R |
| 4,514,620 A | | 4/1985 | Cheng et al. | 219/553 |
| 4,591,700 A | | 5/1986 | Sopory | 219/505 |
| 4,859,836 A | | 8/1989 | Lunk et al. | 219/548 |
| 5,250,226 A | | 10/1993 | Oswal et al. | 252/500 |
| 5,451,919 A | * | 9/1995 | Chu et al. | 338/22 R |
| 5,554,679 A | * | 9/1996 | Cheng | 524/495 |
| 5,582,770 A | * | 12/1996 | Chu et al. | 252/511 |
| 5,747,147 A | | 5/1998 | Wartenberg et al. | 428/209 |
| 5,801,612 A | | 9/1998 | Chandler et al. | 338/22 R |
| 5,837,164 A | * | 11/1998 | Zhao | 252/500 |

FOREIGN PATENT DOCUMENTS

| | | |
|---|---|---|
| EP | 0 460 790 A | 12/1991 |
| JP | 56-6309 | 1/1981 |
| JP | 8-172001 | 7/1996 |
| JP | 11-168005 | 6/1999 |

OTHER PUBLICATIONS

Internation Search Report for International Application No. PCT/US00/20202 mailed Apr. 19, 2001.

K. Ohe and Y. Naito, "A New Resistor Having An Anomalously Large Positive Temperature Coefficient", *Japanese Journal of Applied Physics*, vol. 10, No. 1, Jan. 1971, pp.99–108.

* cited by examiner

*Primary Examiner*—Yogendra N. Gupta
*Assistant Examiner*—D G Hamlin
(74) *Attorney, Agent, or Firm*—Marguerite E. Gerstner

(57) ABSTRACT

An electrically conductive polymer composition containing a polymer mixture containing a first crystalline polymer having a weight-average molecular weight of at least 50,000 and a second crystalline polymer having a weight-average molecular weight of at most 10,000, and a particulate electrically conductive filler has good processability and exhibits a low resistivity at 20° C. and a good positive temperature coefficient (PTC) behavior.

16 Claims, No Drawings

ELECTRICALLY CONDUCTIVE POLYMER COMPOSITION

BACKGROUND OF THE INVENTION

1. Field of the Invention

This invention relates to an electrically conductive polymer composition exhibiting positive temperature coefficient (PTC) of electrical resistance behavior. Said composition can be used in PTC devices.

2. Introduction to the Invention

Conductive polymer compositions which exhibit PTC (positive temperature coefficient of resistance ) behavior are well-known for use in electrical devices such as circuit protection devices. Such compositions comprise a polymeric component, and dispersed therein, a particulate conductive filler such as carbon black or metal. The amount and type of filler in the composition are determined by the required resistivity for each application, as well as by the nature of the polymeric component. Compositions suitable for use in circuit protection devices have low resistivities at room temperature, e.g. less than 100 ohm-cm, and generally comprise relatively high levels of conductive filler.

Compositions with low resistivity are desirable for use in circuit protection devices which respond to changes in ambient temperature and/or current conditions. Under normal conditions, a circuit protection device remains in a low temperature, low resistance state in series with a load in an electrical circuit. When exposed to an overcurrent or overtemperature condition, however, the device increases in resistance, effectively shutting down the current flow to the load in the circuit. For many applications it is desirable that the device have as low a resistance as possible in order to minimize the effect on the resistance of the electrical circuit during normal operation. Although low resistance devices can be made by changing dimensions, e.g. making the distance between the electrodes very small or the device area very large, small devices are preferred because they occupy less space on a circuit board and generally have desirable thermal properties. The most common technique to achieve a small device is to use a composition that has a low resistivity.

The resistivity of a conductive polymer composition can be decreased by adding more conductive filler, but this process can affect the processability of the composition, e.g. by increasing the viscosity. Furthermore, the addition of conductive filler generally reduces the size of the PTC anomaly, i.e. the size of the increase in resistivity of the composition in response to an increase in temperature, generally over a relatively small temperature range. The required PTC anomaly is determined by the applied voltage and the application.

Japanese Patent Kokai Publication No. 172001/1996 (Heisei 08-172001) discloses that metal particles and metal-coated particles are used as the electrically conductive particles, because it is difficult to achieve electrically conductive material having a volume resistivity of at most 1 ohm-cm and good PTC anomaly when carbon black is used as the electrically conductive particles. However, the amount of the electrically conductive particles must be increased to decrease the resistivity. When the amount of the electrically conductive particles is increased, it is impossible to give sufficient PTC anomaly and molding of the composition is difficult due to poor flowability of the composition. Actually, the resultant value of the volume resistivity is limited.

Japanese Patent Kokai Publication No. 6309/1981 (Showa 56-6309) discloses a temperature sensor comprising electrically conductive particles dispersed in an insulative matrix. The insulative matrix comprises an aluminum soap added to a hydrocarbon wax. However, this temperature sensor does not exhibit sufficient PTC behavior.

Japanese Patent Kokai Publication No. 168005/1999 (Heisei 11-168005) discloses an organic PTC thermistor comprising an electrically conductive composition comprising a thermoplastic polymer matrix, a low molecular weight organic compound and electrically conductive particles. This publication describes that hydrocarbons, fatty acids, fatty acid esters, fatty acid amides, aliphatic amines and higher alcohols are used as the low molecular weight organic compound, but does not describe that a polymer is used as the low molecular weight organic compound. The electrically conductive composition has poor processability and does not have good PTC anomaly.

Hitherto, electrically conductive compositions having low volume resistivity have been obtained by adding a large amount of electrically conductive particles such as carbon black and metal powder to a matrix such as a polymer. However, electrically conductive compositions having satisfactory PTC anomaly cannot be obtained.

SUMMARY OF THE INVENTION

An object of the present invention is to provide an electrically conductive composition having good flowability at high temperature and low resistivity at 20° C. and exhibiting good PTC anomaly.

In a first aspect, the present invention provides an electrically conductive polymer composition exhibiting positive temperature coefficient (PTC) of electrical resistance behavior and comprising:

(1) a polymer mixture comprising:
  (i) at least 50% by volume of a first crystalline polymer having a weight-average molecular weight of at least 50,000, and
  (ii) at most 50% by volume of a second crystalline polymer having a weight-average molecular weight of at most 10,000, and (2) a particulate electrically conductive filler dispersed in the polymer mixture.

In a second aspect, the present invention provides a PTC device comprising:

(A) a PTC element (for example, a laminar PTC element) comprising the composition, and of the first aspect of the invention.

(B) two electrodes which can be connected to an electrical power source to pass an electrical current through the PTC element.

In a third aspect, the present invention provides an electrical circuit which comprises:

(I) the PTC device; of the second aspect of the invention.

(II) an electrical power source; and (III) a load connected in series with the device and the power source.

DETAILED DESCRIPTION OF THE INVENTION

The electrically conductive polymer composition of the present invention comprises a polymer mixture comprising a first crystalline polymer and a second crystalline polymer, and a particulate electrically conductive filler, and exhibits positive temperature coefficient (PTC) of electrical resistance behavior.

The polymer mixture comprises a first crystalline polymer and a second crystalline polymer. Preferably, the amount of the polymer mixture is from 20 to 90% by volume, more preferably 20 to 70% by volume, especially 30 to 70% by volume, based on total volume of the electrically conductive polymer composition.

The first crystalline polymer has a weight-average molecular weight of at least 50,000. The lower limit of the weight-average molecular weight of the first crystalline polymer is 50,000, preferably 100,000. The upper limit of the weight-average molecular weight of the first crystalline polymer is generally 10,000,000, e.g. 3,000,000, preferably 1,000,000, more preferably 600,000.

The crystallinity of the first crystalline polymer may be at least 10%, preferably at least 20%, more preferably at least 30%, especially at least 40%, e.g. from 50 to 98%.

The first crystalline polymer is generally a thermoplastic resin. Preferably, the first crystalline polymer is a polymer comprising at least one monomer selected from olefins or olefin derivatives, e.g. a homopolymer or copolymer of ethylene. Suitable examples of the first crystalline polymer include polymers of one or more olefins such as high density polyethylene; copolymers of at least one olefin and at least one monomer copolymerisable therewith such as ethylene/acrylic acid, ethylene/ethyl acrylate, ethylene/vinyl acetate, and ethylene/butyl acrylate copolymers; melt-shapeable fluoropolymers such as polyvinylidene fluoride and ethylene/tetrafluoroethylene copolymers; and blends of two or more such polymers.

The amount of the first crystalline polymer is at least 50% by volume, e.g. at least 60% by volume, particularly at least 70% by volume, especially at least 80% by volume, based on the polymer mixture.

The second crystalline polymer has a weight-average molecular weight of at most 10,000. Preferably, the lower limit of the weight-average molecular weight of the second crystalline polymer is 500, preferably 800, more preferably 1000, particularly 2000. The upper limit thereof is 10,000, preferably 9,000, more preferably 8,000.

Preferably, the lower limit of the melting point ($T_{m2}$) of the second crystalline polymer is 60° C., more preferably 90° C., most preferably 100° C., e.g. 105° C., particularly 110° C., more particularly 115° C., especially 120° C., more especially 125° C. Preferably, the upper limit of the melting point ($T_{m2}$) of the second crystalline polymer is 200° C., more preferably 180° C., especially 140° C.

The crystallinity of the second crystalline polymer may be at least 20%, preferably at least 50%. The lower limit of the crystallinity of the second crystalline polymer may be 60%, particularly 70%, especially 80%. The upper limit thereof is not limited, and may be 98%, particularly 95%, especially 92%.

The second crystalline polymer has at least one repeat unit derived from a monomer having a carbon-carbon double bond. The second crystalline polymer can be synthesized by polymerizing at least one monomer selected from olefins or olefin derivatives. Preferably, the second crystalline polymer is a homopolymer or copolymer of olefin such as ethylene or propylene (e.g. polyethylene, polypropylene, ethylene/ethyl acrylate copolymer).

The upper limit of the amount of the second polymer is 50% by volume, e.g. 40% by volume, particularly 30% by volume, especially 20% by volume, based on the polymer mixture. The lower limit of the amount of the second polymer may be 2% by volume, particularly 5% by volume, especially 10% by volume.

The crystallinity of the polymer mixture may be at least 20%, generally at least 40%, e.g. at least 60%, particularly at least 70%, especially at least 80%.

Preferably, a difference of the difference in melting point between the first and second crystalline polymers is at most 50° C., more preferably at most 30° C., particularly at most 20° C.

The weight-average molecular weight of the polymers (i.e. the first and second crystalline polymers) is measured by gel permeation chromatography (GPC) (in terms of polystyrene).

The crystallinity of the polymers (i.e. the first and second crystalline polymers, and the polymer mixture) is usually measured by DSC (differential scanning calorimetry). The crystallinity can be measured by another method, e.g. X-ray diffraction, if the crystallinity cannot be measured by DSC, for example, if the numeral value of the crystallinity is low.

The melting point of the polymers means a melting peak temperature as measured by DSC.

The electrically conductive polymer composition comprises a particulate electrically conductive filler. The particulate electrically conductive filler includes carbon black, graphite, other carbonaceous materials, metal, metal oxide, electrically conductive ceramic, electrically conductive polymer, and a combination thereof Examples of carbonaceous material are carbon black, graphite, glassy carbon and carbon beads. Examples of metal are gold, silver, copper, nickel, aluminum and alloys thereof Examples of metal oxide are ITO (indium-tin oxide), lithiummanganese complex oxide, vanadium pentoxide, tin oxide and potassium titanate. Examples of electrically conductive ceramic are carbide (for example, tungsten carbide, titanium carbide and complexes thereof), titanium borate and titanium nitride. Examples of electrically conductive polymer are polyacetylene, polypyrene, polyaniline, polyphenylene and polyacene.

Preferably, the amount of the particulate conductive filler is from 10 to 80% by volume, more preferably from 30 to 80% by volume, particularly from 30 to 70% by volume, based on the total volume of the electrically conductive polymer composition.

The electrically conductive polymer composition may comprise additional components, such as antioxidants, inert fillers, nonconductive fillers, crosslinking agents, such as radiation crosslinking agents (often referred to as prorads or crosslinking enhancers, e.g. triallyl isocyanurate), stabilizers, dispersing agents, coupling agents, acid scavengers (e.g. $CaCO_3$), flame retardants, arc suppressants, coloring agents or other polymers. These components comprise generally at most 20% by volume, e.g. at most 10% by volume of the total volume of the composition.

Preferably, a ratio ($\rho_m/\rho_{20}$)of a volume resistivity ($\rho_m$)at a melting point of the electrically conductive polymer composition (i.e. at a melting point ($T_{m1}$) of the first crystalline polymer) to a volume resistivity ($\rho_{20}$) at 20° C. of the electrically conductive polymer composition is at least 50, e.g. at least 100, particularly at least 300, especially at least 1,000.

A volume resistivity ($\rho_{20}$, a volume resistivity at 20° C.)of the electrically conductive polymer composition is generally at most 100 ohm-cm, e.g. at most 10 ohm-cm, particularly at most 1 ohm-cm, more particularly at most 0.25 ohm-cm, more especially at most 0.15 ohm-cm. The volume resistivity ($\rho_{20}$) of the composition depends on the application and what type of electrical device is required. When, as is preferred, the composition is used for circuit protection devices, the composition has a lower resistivity.

The electrically conductive polymer composition and the PTC device of the present invention can be prepared as follows:

The first crystalline polymer, the second crystalline polymer and the particulate electrically conductive filler are charged into a mixing apparatus and kneaded at high temperature to give a molten mixture (that is, the electrically conductive polymer composition). The kneading temperature is a temperature higher than the melting points of the first and second crystalline polymers, and is generally from 120 to 250° C. The mixing apparatus may be an extruder, such as a single screw extruder or a twin screw extruder, or other types of mixing equipment, such as Banbury™ mixers and Brabender™ mixers.

Then the molten mixture is shaped into a polymeric sheet. This can be achieved easily by extrusion through a sheet die or by calendering the molten mixture, i.e. passing the molten mixture between rollers or plates to thin it into a sheet. The thickness of the calendered sheet is determined by the distance between the plates or rollers, as well as the rate at which the rollers are rotating. Generally the polymeric sheet has a thickness of 0.025 to 3.8 mm, preferably 0.051 to 2.5 mm. The polymeric sheet may have any width. The width is determined by the shape of the die or the volume of material and rate of calendering, and is often 0.10 to 0.45 m, e.g. 0.15 to 0.31 m.

A laminate is formed by attaching metal foil to at least one side, preferably to both sides, of the polymeric sheet. When the laminate is cut into an electrical device, the metal foil layer(s) act(s) as an electrode. The metal foil generally has a thickness of at most 0.13 mm, preferably at most 0.076 mm, particularly at most 0.051 mm, e.g. 0.025 mm. The width of the metal foil is generally approximately the same as that of the polymeric sheet, but for some applications, it may be desirable to apply the metal foil in the form of two or more narrow ribbons, each having a width much less than that of the polymeric sheet. Suitable metal foils include nickel, copper, brass, aluminum, molybdenum, and alloys, or foils which comprise two or more of these materials in the same or different layers. Metal foils may have at least one surface that is electrodeposited, preferably electrodeposited nickel or copper. For some applications, an adhesive composition (i.e. a tie layer) may be applied to the polymeric sheet, e.g. by spraying or brushing, before contact with the metal foil. The laminate may be wound onto a reel or sliced into discrete pieces for further processing or storage. The thickness of the laminate is generally 0.076 to 4.1 mm.

When the laminate comprises two metal foils, it can be used to form an electrical device, particularly a circuit protection device. The device may be cut from the laminate. In this application, the term "cut" is used to include any method of isolating or separating the device from the laminate.

Additional metal leads, e.g. in the form of wires or straps, can be attached to the foil electrodes to allow electrical connection to a circuit. In addition, elements to control the thermal output of the device, e.g. one or more conductive terminals, can be used. These terminals can be in the form of metal plates, e.g. steel, copper, or brass, or fins, that are attached either directly or by means of an intermediate layer such as solder or a conductive adhesive, to the electrodes. For some applications, it is preferred to attach the devices directly to a circuit board.

In order to improve the electrical stability of the device, it is often desirable to subject the device to various processing techniques, e.g. crosslinking and/or heat-treatment. Crosslinking can be accomplished by chemical means or by irradiation, e.g. using an electron beam or a $Co^{60}$ irradiation source. The level of crosslinking depends on the required application for the composition, but is generally less than the equivalent of 200 Mrads, and is preferably substantially less, i.e. from 1 to 20 Mrads, preferably from 1 to 15 Mrads, particularly from 2 to 10 Mrads for low voltage (i.e. less than 60 volts) circuit protection applications. Generally devices are crosslinked to the equivalent of at least 2 Mrads.

Devices of the invention are preferably circuit protection devices that generally have a resistance at 20° C. of less than 10 ohms, preferably less than 5 ohms, particularly less than 2 ohms, more particularly less than 1 ohm, especially less than 0.5 ohms, more especially less than 0.1 ohm, most especially less than 0.05 ohm. Because the laminate prepared by the method of the invention comprises a conductive polymer composition which can have a low resistivity, it can be used to produce devices with very low resistances, e.g. 0.001 to 0.100 ohm.

The electrically conductive polymer composition of the present invention can be used as an overcurrent protection device (a circuit protection device), a PTC thermistor, a temperature sensor and the like.

The electrically conductive polymer composition of the present invention has a low melt viscosity and exhibits good PTC anomaly, even if a large amount of the particulate electrically conductive filler is loaded to give a decreased volume resistivity at normal temperature (for example, 20° C.) of the composition. The electrically conductive polymer composition of the present invention has good processability, the thickness of the PTC device can be smaller and the speed of lamination of the electrically conductive polymer composition layer and electrode layers can be higher. In addition, the PTC device has good adhesion between the electrically conductive polymer composition layer and the electrode layers. The present invention gives a PTC device having a small size, a light weight and a low electrical resistance.

The devices of the invention are often used in an electrical circuit which comprises a source of electrical power (e.g. DC power source or AC power source), a load, e.g. one or more resistors, and the device. In order to connect the device of the invention to the other components in the circuit, it may be necessary to attach one or more additional metal leads, e.g. in the form of wires or straps, to the metal foil electrodes. In addition, elements to control the thermal output of the device, i.e. one or more conductive terminals, can be used. These terminals can be in the form of metal plates, e.g. steel, copper, or brass, or fins, which are attached either directly or by means of an intermediate layer such as solder or a conductive adhesive, to the electrodes.

PREFERRED EMBODIMENTS OF THE INVENTION

EXAMPLES AND COMPARATIVE EXAMPLES ARE ILLUSTRATED HEREINAFTER

The amount of components constituting the electrically conductive polymer composition is by volume (% by volume), in the following Examples.

Measurement of volume resistivity at 20° C. ($\rho_{20}$) and volume resistivity at melting point ($\rho_m$).

A resistance of a test piece is measured and then a volume resistivity ($\rho$) was calculated according to the following equation:

$$\text{(Volume resistivity)}=\text{(Resistance of test piece)}\times\text{(Area of electrode)}\div[\text{(Thickness of test piece)}-\text{(Thickness of electrode foil)}\times 2]$$

A volume resistivity at 20° C. ($\rho_{20}$) and a volume resistivity at a melting point of the first crystalline polymer ($\rho_m$) were determined.

Examples 1 to 5 and Comparative Examples 1 to 3

Raw materials having the formulation (% by volume) shown in Tables 1 and 2 were charged at a loading of 75% into 60 cc Labo Plastomill 50C150 (manufactured by Toyo Seiki Seisakusyo Kabushiki Kaisha) equipped with a roll blade (R60B) and kneaded at 210° C. and 40 rpm for 15 minutes. Then a sheet having a thickness of about 0.5 mm was prepared by a pressing machine. Nickel foils having rough surface (manufactured by Fukuda Kinzoku Hakufun Kogyo Kabushiki Kaisha) were hot-pressed on both sides of the sheet at 210° C. and stamped to give a disc having a diameter of 6.35 mm. The disc was crosslinked by irradiating the disc (with γ-ray 7 Mrad). The disc was subjected to a temperature cycle to stabilize the resistance value. Then a resistance at 20° C., a thickness and the resistance change depending on the temperature of the test piece (namely, the disc) were measured. The torque applied to the Labo Plastimill at the end of kneading of raw materials was regarded as the final torque. Results are shown in Tables 1 and 2.

TABLE 1

| | Ex. 1 | Ex. 2 | Ex. 3 | Ex. 4 | Ex. 5 |
|---|---|---|---|---|---|
| First crystalline polymer | 44.8 | 50.4 | 48.0 | 50.4 | 44.8 |
| Second crystalline polymer (a) | 11.2 | 5.6 | 12.0 | — | — |
| Second crystalline polymer (b) | — | — | — | — | 11.2 |
| Second crystalline polymer (c) | — | — | — | 5.6 | — |
| Paraffin wax | — | — | — | — | — |
| Carbon black | 44.0 | 44.0 | 40.0 | 44.0 | 44.0 |
| Total (% by volume) | 100 | 100 | 100 | 100 | 100 |
| Final torque (kg-m) | 4.19 | 4.71 | 3.16 | 4.58 | 3.79 |
| After γ-ray irradiation | | | | | |
| Volume resistivity at 20° C. ($\rho_{20}$) | 0.15 | 0.21 | 0.22 | 0.21 | 0.12 |
| Volume resistivity at melting point ($\rho_m$) | 715 | 484 | 3298 | 503 | 352 |
| Ratio of volume resistivity ($\rho_m/\rho_{20}$) | 4767 | 2420 | 14990 | 2395 | 2933 |
| Ratio of volume (First polymer/Second polymer) | 80/20 | 90/10 | 80/20 | 90/10 | 80/20 |

TABLE 2

| | Comparative Ex. 1 | Comparative Ex. 2 | Comparative Ex. 3 |
|---|---|---|---|
| First crystalline polymer | 43.2 | 65.0 | 60.0 |
| Second crystalline polymer (a) | — | — | — |
| Second crystalline polymer (b) | — | — | — |
| Second crystalline polymer (c) | — | — | — |
| Paraffin wax | 10.8 | — | — |
| Carbon black | 46.0 | 35.0 | 40.0 |
| Total (% by volume) | 100 | 100 | 100 |
| Final torque (kg-m) | 4.88 | 3.17 | 4.18 |
| After γ-ray irradiation | | | |
| Volume resistivity at 20° C. ($\rho_{20}$) | 0.23 | 0.58 | 0.27 |
| Volume resistivity at melting point ($\rho_m$) | 34.08 | 79800 | 7415 |
| Ratio of volume resistivity ($\rho_m/\rho_{20}$) | 148 | 137586 | 27463 |
| Ratio of volume (First polymer/Wax) | 80/20 | — | — |

The used raw materials used were as follows:

First crystalline polymer

High density polyethylene having a weight-average molecular weight (measured by GPC) of about 350,000, a crystallinity (measured by DSC) of 80%, a melting point (measured by DSC) of 137° C. and a density of 0.96 g/cm$^3$.

Second crystalline polymer (a)

Polyethylene having a weight-average molecular weight (measured by GPC) of about 8,000, a crystallinity (measured by DSC) of 84%, a melting point (measured by DSC) of 127° C. and a density of 0.97 g/cm$^3$.

Second crystalline polymer (b)

Polyethylene having a weight-average molecular weight (measured by GPC) of about 4,000, a crystallinity (measured by DSC) of 90%, a melting point (measured by DSC) of 126° C. and a density of 0.98 g/cm$^3$.

Second crystalline polymer (c)

Polyethylene having a weight-average molecular weight (measured by GPC) of about 900, a crystallinity (measured by DSC) of 83%, a melting point (measured by DSC) of 116° C. and a density of 0.95 g/cm$^3$.

Paraffin wax

Paraffin wax having an average molecular weight (measured by gas chromatography) of 361, a crystallinity (measured by DSC) of 71%, a melting point (measured by DSC) of 55° C. and a density of 0.902 g/cm$^3$.

Carbon black

Furnace black having a DBP oil-absorbing amount of 80 cc/100 g, a iodine-absorbing amount of 34 mg/g, and pH of 7.

The results of Examples and Comparative Examples are studied hereinafter

Example 1 and Comparative Example 1

Although Example 1 uses a smaller amount of carbon black than Comparative Example 1, Example 1 gives a lower 20° C. volume resistivity than Comparative Example 1. Example 1 has a smaller final torque than Comparative Example 1 so that Example 1 has better processability than Comparative Example 1. Example 1 gives a larger ratio of volume resistivity ($\rho_m/\rho_{20}$) than Comparative Example 1.

Example 2–4 and Comparative Example 1

Although the 20° C. volume resistivity is almost the same between Examples 2–4 and Comparative Example 1, Comparative Example 1 needs a larger amount of carbon black, has a larger final torque at the kneading, and gives a remarkably worse ratio of volume resistivity ($\rho_m/\rho_{20}$) than Examples 2–4.

Example 3 and Comparative Example 2

Although the final torque at the kneading is almost the same between Example 3 and Comparative Example 2, Example 3 gives a 20° C. volume resistivity smaller than half of the volume resistivity of Comparative Example 2 and gives a sufficient volume resistivity ($\rho_m/\rho_{20}$) so that the remarkable improvement in the present invention can be observed.

Example 3 and Comparative Example 3

Example 3 and Comparative Example 3 use the same amount of carbon black. However, the addition of the second crystalline polymer in Example 3 remarkably improves the final torque at the kneading, and gives a sufficient 20° C. volume resistivity and a sufficient ratio of volume resistivity ($\rho_m/\rho_{20}$).

Example 1 and Comparative Example 3

Although Example 1 uses 44% by volume of carbon black, the final torque is small so that the processability is good. The final torque in Example 1 is almost the same as that in Comparative Example 3 which uses 40% by volume of carbon black. In addition, Example 1 gives a better $\rho_{20}$ than Comparative Example 3.

What is claimed is:

1. An electrically conductive polymer composition exhibiting positive temperature coefficient (PTC) of electrical resistance behavior and comprising:

(1) a polymer mixture comprising:

(i) at least 50% by volume of a first crystalline polymer having a weight-average molecular weight of at least 50,000, and (ii) at most 50% by volume of a second crystalline polymer having a weight-average molecular weight of at most 10,000, and (2) a particulate electrically conductive filler dispersed in the polymer mixture.

2. A composition according to claim 1, wherein the particulate electrically conductive filler comprises 30% to 80% by volume of the electrically conductive polymer composition.

3. A composition according to claim 1, which has a volume resistivity at 20° C. of at most 1.0 ohm-cm.

4. A composition according to claim 1, wherein a ratio ($\rho_m/\rho_{20}$) of a volume resistivity at a melting point ($\rho_m$) of the electrically conductive polymer composition to a volume resistivity at 20° C. ($\rho_{20}$) of the electrically conductive polymer composition is at least 50.

5. A composition according to claim 1, wherein the first crystalline polymer has a crystallinity of at least 20%.

6. A composition according to claim 1, wherein the second crystalline polymer has a crystallinity of at least 50%.

7. A composition according to claim 1, wherein the first crystalline polymer is a polymer comprising at least one monomer selected from olefins or olefin derivatives.

8. A composition according to claim 1, wherein the first crystalline polymer is a homopolymer or copolymer of ethylene.

9. A composition according to claim 1, wherein the second crystalline polymer is a homopolymer or copolymer of ethylene.

10. A composition according to claim 1, wherein a difference of melting point between the first and second crystalline polymers is at most 50° C.

11. A composition according to claim 1, wherein the particulate electrically conductive filler comprises carbon black, graphite, other carbonaceous material, metal, metal oxide, electrically conductive ceramic, electrically conductive polymer or a combination thereof.

12. A composition according to claim 1, which further comprises an additional component which acts as an arc suppressant, flame retardant, stabilizer, antioxidant, acid scavenger, crosslinking agent or combination thereof.

13. A PTC device comprising:

(A) a PTC element comprising an electrically conductive polymer composition comprising (1) a polymer mixture comprising (i) at least 50% by volume of a first crystalline polymer having a weight-average molecular weight of at least 50,000, and (ii) at most 50% by volume of a second crystalline polymer having a weight-average molecular weight of at most 10,000, and (2) a particulate electrically conductive filler dispersed in the polymer mixture, and (B) two electrodes which can be connected to an electrical power source to pass an electrical current through the PTC element.

14. A device according to claim 13, in which the polymer composition has been crosslinked.

15. A device according to claim 13, which has a resistance at 20° C. of at most 1.0 ohm.

16. An electrical circuit which comprises:

(I) a PTC device comprising (A) a PTC element comprising an electrically conductive polymer composition comprising (1) a polymer mixture comprising (i) at least 50% by volume of a first crystalline polymer having a weight-average molecular weight of at least 50,000, and (ii) at most 50% by volume of a second crystalline polymer having a weight-average molecular weight of at most 10,000, and (2) a particulate electrically conductive filler dispersed in the polymer mixture, and (B) two electrodes which can be connected to an electrical power source to pass an electrical current through the PTC element;

(II) an electrical power source; and (III) a load connected in series with the device and the power source.

* * * * *